US009637966B1

(12) United States Patent
Kun

(10) Patent No.: US 9,637,966 B1
(45) **Date of Patent: *May 2, 2017**

(54) CUPBOARD WITH UP-DOWN LOUVERED DOOR

(71) Applicant: Cmech (Guangzhou) Ltd., Guangdong (CN)

(72) Inventor: Ding Gou Kun, Guangdong (CN)

(73) Assignee: Cmech (Guangzhou) Ltd., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/211,056

(22) Filed: Jul. 15, 2016

(30) Foreign Application Priority Data

Dec. 29, 2015 (CN) ..... 2015 1 1023663

(51) Int. Cl.
*A47B 97/00* (2006.01)
*E05F 15/605* (2015.01)
(Continued)

(52) U.S. Cl.
CPC ..... *E05F 15/605* (2015.01); *A47B 95/02* (2013.01); *A47B 96/00* (2013.01); *E05D 15/165* (2013.01);
(Continued)

(58) Field of Classification Search
CPC ..... E06B 9/302; E06B 3/483; E06B 3/928; E06B 9/0638; E06B 9/0676; Y10S 160/901; E05Y 2900/132; E05Y 2900/20; E05D 13/14; E05D 15/582; A47B 97/00
USPC ..... 160/189, 190, 201, 207; 312/319.5–319.8, 297, 325; 49/82.1, 49/86.1, 90.1
See application file for complete search history.

(56) References Cited

U.S. PATENT DOCUMENTS 702,148 A * 6/1902 McCloud ..... E06B 7/084 49/403
799,398 A * 9/1905 McMullen ..... E06B 3/481 160/159
(Continued)

FOREIGN PATENT DOCUMENTS

CA 1108198 * 9/1981
DE 4020334 * 1/1992
(Continued)

OTHER PUBLICATIONS

Translation for EP 2248983.*

*Primary Examiner* — Janet M Wilkens
(74) *Attorney, Agent, or Firm* — McKee, Voorhees & Sease, PLC

(57) ABSTRACT

A cupboard has a body and an up-down louvered door. The door comprises a plurality of louvers, and a pair of lift racks to which the louvers are attached. The cupboard also includes a motor transmission apparatus, and two belts. When people need to open the door, the motor is actuated, whereby the lift racks lift and fold up, causing the louvers to fold up, and thus the door is opened. When people need to close the door, the motor is reversed, such that lift racks descend and extend, causing the louvers to extend, and thus the door is closed. The door can open adequately so as to facilitate taking out/putting in articles. No more space is occupied while opening the door, and the door is safe while closing. A small driving force can open/close the door.

22 Claims, 6 Drawing Sheets

(51) Int. Cl.

| | |
|---|---|
| ***A47B 95/02*** | (2006.01) |
| ***A47B 96/00*** | (2006.01) |
| ***E05F 15/665*** | (2015.01) |
| ***E06B 7/084*** | (2006.01) |
| ***E05F 11/54*** | (2006.01) |
| ***E05D 15/16*** | (2006.01) |
| ***E05D 15/26*** | (2006.01) |
| ***E06B 3/92*** | (2006.01) |
| ***E06B 5/00*** | (2006.01) |
| ***E06B 7/082*** | (2006.01) |

(52) U.S. Cl.

CPC ..... *E05D 15/262* (2013.01); *E05F 11/54* (2013.01); *E05F 15/665* (2015.01); *E06B 3/928* (2013.01); *E06B 5/006* (2013.01); *E06B 7/082* (2013.01); *E06B 7/084* (2013.01); *E05Y 2900/20* (2013.01)

(56) References Cited

U.S. PATENT DOCUMENTS 1,709,872 A * 4/1929 Peelle ..... E05D 13/14 160/189
1,832,966 A * 11/1931 Cook ..... E06B 3/925 160/138
1,892,340 A * 12/1932 Guth ..... E06B 3/483 160/147
1,965,262 A * 7/1934 Seregi ..... E06B 9/302 160/165
2,237,800 A * 4/1941 Webber ..... E06B 9/302 160/172 R
2,389,956 A * 11/1945 Castilonia ..... E06B 9/302 160/172 R
2,621,723 A * 12/1952 Etten ..... E06B 9/302 160/168.1 R
2,672,928 A * 3/1954 King, Jr. ..... E04F 10/10 160/172 R
2,688,365 A * 9/1954 Garubo ..... E06B 3/928 160/172 R
2,760,566 A * 8/1956 Musheli ..... E06B 9/302 160/168.1 R
3,008,519 A * 11/1961 Hawkins ..... B60J 1/2088 160/169
3,304,994 A * 2/1967 Kozak ..... E06B 3/925 160/193
3,378,059 A * 4/1968 Young ..... E06B 3/483 160/165
5,062,464 A * 11/1991 Peterson ..... E06B 3/94 160/138
5,163,494 A * 11/1992 MacNeil ..... E06B 3/928 160/188
5,170,108 A * 12/1992 Peterson ..... E06B 9/32 160/168.1 P
5,893,403 A * 4/1999 Megens ..... E05D 15/262 160/207
5,934,776 A * 8/1999 Motta ..... E06B 9/115 109/15
5,983,971 A * 11/1999 Miller ..... E06B 9/0638 160/170
6,145,568 A * 11/2000 Lundstrom ..... E06B 9/0692 160/189
6,311,757 B1 * 11/2001 Schuette ..... E06B 9/0638 160/189
6,953,074 B2 * 10/2005 Cardinal ..... E06B 9/0676 160/168.1 R
7,156,142 B2 * 1/2007 Peterson ..... E06B 3/928 160/138
8,302,654 B2 * 11/2012 McDonald ..... E06B 9/0638 160/193
8,555,948 B2 * 10/2013 Park ..... E06B 7/086 160/172 R
9,267,320 B2 * 2/2016 Kitterman ..... E05F 17/00
2005/0126721 A1 * 6/2005 Fan ..... E05D 15/165 160/201
2010/0072868 A1 * 3/2010 Deem ..... E06B 3/925 312/319.7

FOREIGN PATENT DOCUMENTS

DE 202010011321 U1 12/2010
EP 2248983 * 11/2010
EP 2586956 * 5/2013

* cited by examiner

CUPBOARD WITH UP-DOWN LOUVERED DOOR

35 U.S.C. §119 CLAIM FOR PRIORITY

This application claims priority to Chinese Application Serial No. 201511023663.6, filed on Dec. 29, 2015.

FIELD OF THE INVENTION

The present invention relates to a cupboard with an up-down louvered door.

BACKGROUND OF THE INVENTION

A cupboard is used for storage, for example, a clothes cupboard, a kitchen cupboard and a shoes cupboard. A cupboard is usually equipped with a door. People can open the door to take articles out, and close the door for preventing articles inside the cupboard from humidification, and hiding the articles so as to have a good appearance.

However some inconveniences may be encountered while using a cupboard, for example:

1. When the door is configured as a horizontal slide door, there are usually two slide doors, i.e. a left door and a right door. The left door can be pushed to right side, so that articles can thus be taken out from left side of the cupboard, or the right door can be pushed to the left side, so that articles can thus be taken out from the right side of the cupboard. However it is impossible to place a big article into a center of cupboard unless both the left and right doors are removed.

When the door is configured as a swing door, people can place a big article into the center of cabinet, but the door must require a certain space for opening. However in a small space, the door may open at a small or limited angle, thus causing difficulty to take out/put in articles in the cupboard.
2. Some doors may be difficult to open, for example, if the door is heavy and needs a great strength to open the door.

Accordingly, a primary objective of the present invention is the provision of an improved cupboard door closer which overcomes the limitations of the prior art.

A further objective of the present invention is the provision of a door closer for a vertically moveable door having a powered transmission to assist in opening and closing of the door.

Another objective of the present invention is the provision of a motorized, door opener for a cupboard door.

SUMMARY OF THE INVENTION

Therefore, it is desirable to provide a cupboard with an up-down, vertically moveable louvered door, which opens adequately so as to facilitate taking out/putting in articles. No more space is occupied or needed while opening the door, and the door is safe while closing.

The present invention is therefore provided as follows:

A cupboard with up-down louvered door, comprises a cupboard body or box, a door configured in the body, wherein the door includes a lift louvered mechanism comprising a plurality of louvers, and lift racks in which the louvers are configured or mounted. The cupboard also includes a motor transmission apparatus, and two belts. One end of both belts is secured to the motor transmission apparatus, and the other end of both belts is connected to the lift racks.

When people need to open the door, a motor of the motor transmission apparatus rotates, the lift racks lift and fold up, causing the louvers to fold up, and thus the door is opened. When people need to close the door, the motor of the motor transmission apparatus reverses, the lift racks descend and extend, causing the louvers to extend, and thus the door is closed.

In a preferred embodiment, the lift racks comprise a plurality of first lift units, and a plurality of second lift units in which each second lift unit is connected to two adjacent first lift units; and the louvers are connected to the first lift units.

Further each first lift unit comprises a first connective element securing to the louver, and a second connective element hinged to the first connective element; and each second lift unit comprises a third connective element hinged to the first connective element, and a fourth connective element hinged to the second connective element; both the third connective element and the fourth connective element are hinged each other. These connective elements form a scissors-type jack assembly.

Further, a guide protrusion is set up on the first connective element; a guideway is configured in the body, for installing the lift rack therein; and a guide groove is configured in the guideway, for restricting the guide protrusion to move therein.

Further, a mounting slot is configured at a left board of the body, and another mounting slot is configured at a right board of the body.

In the preferred embodiment, the motor transmission apparatus comprises a reversible electric motor, a first gear engaged with the motor, and a central gear engaged with the first gear. The central gear has two separate grooves for receiving two belts, and both belts are secured to and wound around the two grooves inversely or oppositely.

In some embodiment, the cupboard comprises a plurality of regulating wheels for tightening/releasing the belts, and the regulating wheels are configured at the left and right boards.

The present invention can bring the following benefits:

For the cupboard with an up-down louvered door of the present invention, the door can open adequately so as to facilitate taking out/putting in articles since the lift racks lift and fold up, causing the louvers to fold up. In addition, no more space is occupied while opening the door, and the door is safe while closing.

Further, the cupboard features simple structure, good stability, low cost and long lifetime.

Further, the present invention includes the motor transmission apparatus, the door can open electrically.

DETAILED DESCRIPTION OF THE PREFERRED EMBODIMENTS

Figure 1:
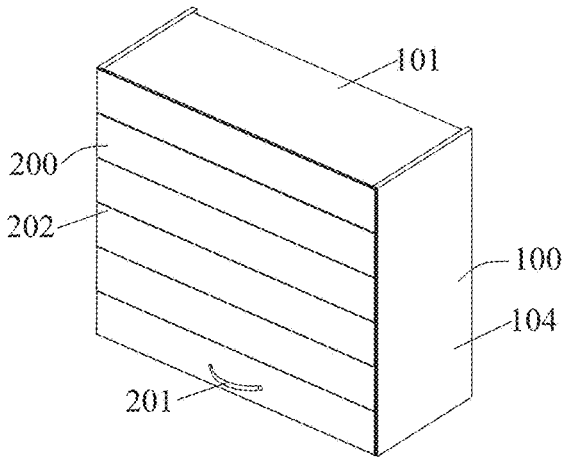
FIG. 1 is a structural schematic view of a cupboard according to the present invention, with the door closed.
Figure 2:
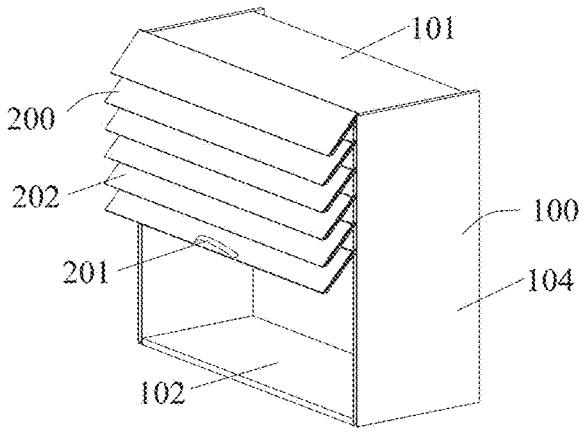
FIG. 2 is a structural schematic view of a cupboard according to the present invention, with the door partially opened.
Figure 3:
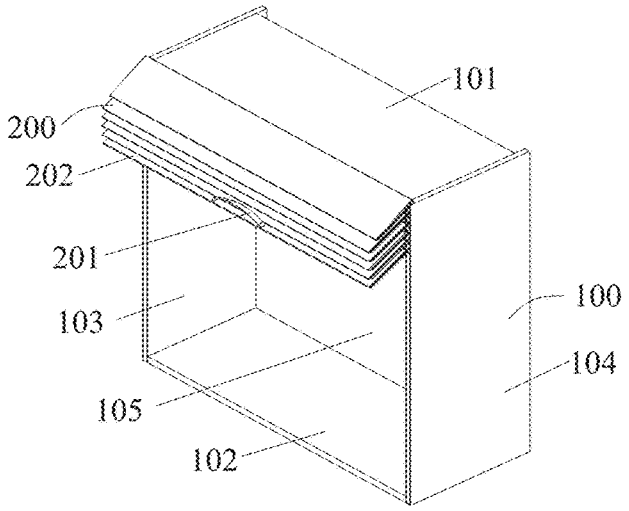
FIG. 3 is a structural schematic view of a cupboard according to the present invention, with the door opened fully.

The present invention will be described hereinafter in details with reference to the FIGS. 1-10.

Embodiment 1

A cupboard with an up-down louvered door is shown in FIGS. 1-10.

The cupboard with the up-down louvered door comprises a cupboard body or box 100 with an open front, a door 200 on the body 100, and a handle 201 mounted on the door 200.

The door 200 adopts a lift louvered mechanism, comprising a plurality of louvers 202, a pair of brackets or lift racks 300 and a guideway 400 for each lift rack 300.

Each lift rack 300 comprises a plurality of first lift units 310, and a plurality of second lift units 320 in which each second lift unit 320 is connected to two adjacent first lift units 310. Each louver 202 is secured to each corresponding first lift unit 310.

Each first lift unit 310 comprises a first connective element or finger 311 secured to the louver 202, and a second connective element 312 hinged to the first connective element 311. Each second lift unit 320 comprises a third connective element 321 hinged to the first connective element 311, and a fourth connective element 322 hinged to the second connective element 312. The third connective element 321 and the fourth connective element 322 are hinged together. Thus, the elements 311, 312, 321, 322 form a scissors-type jack assembly.

As shown in FIGS. 1-4, the cupboard has a door containing multiple louvers 202 which are secured onto multiple first lift units 310 respectively, by any convenient means, such as a strong adhesive, snap-fitting, port connections or the like. More particularly, each louver 202 is secured onto each corresponding first connective element 311 such that the louvers 202 are mounted to the lift racks 300.

Figure 7:
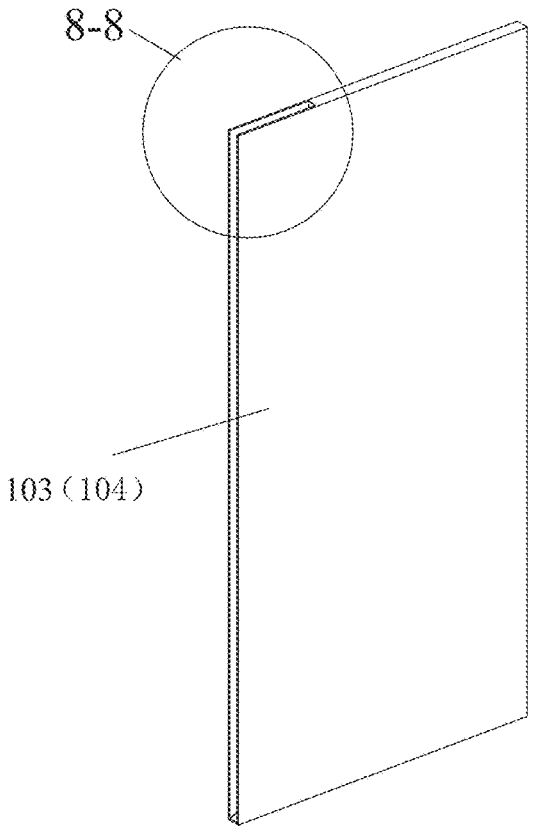
FIG. 7 is a structural schematic view of a left/right side board of the cupboard.
Figure 8:
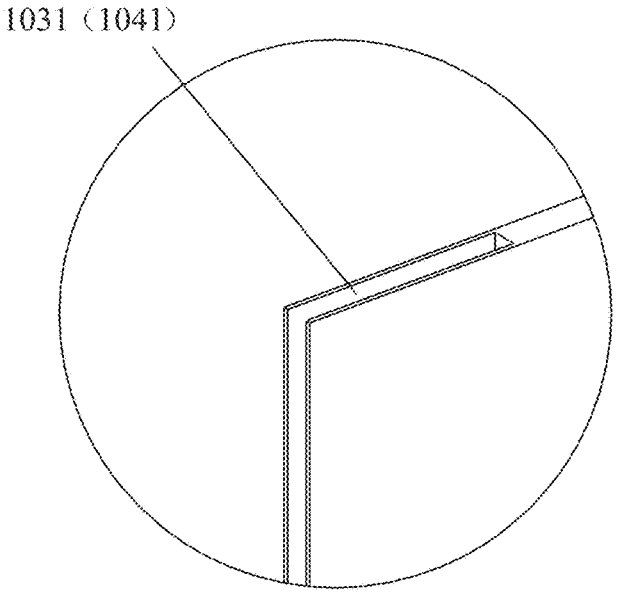
FIG. 8 is an enlarged view of the portion "8" in FIG. 7.
Figure 9:
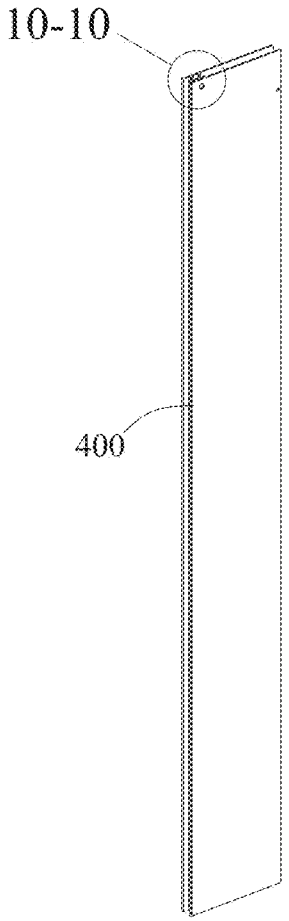
FIG. 9 is a structural schematic view showing a guideway for the lift racks.

The body 100 consists of a top board 101, a bottom board 102, a left board 103, a right board 104 and a rear board 105. As Shown in FIGS. 7-9, a mounting slot 1031 is configured at the left board 103, and a mounting slot 1041 is configured at the right board 104. Meanwhile, two guideways 400 are provided inside the mounting slots 1031 and 1041, respectively, with each lift rack 300 being mounted inside each guideway 400.

Figure 6:
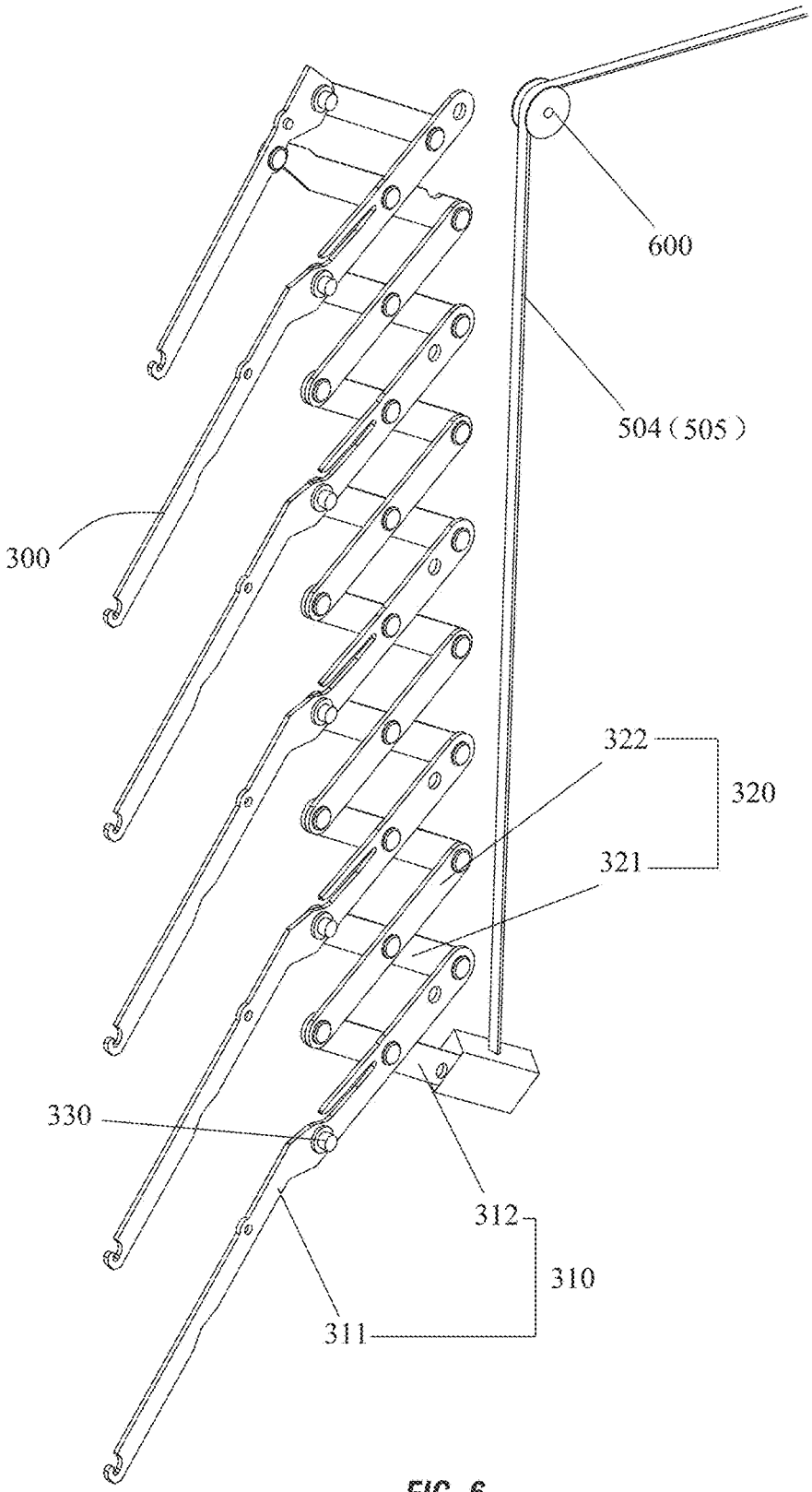
FIG. 6 is a structural schematic view of one of the lift racks.
Figure 10:
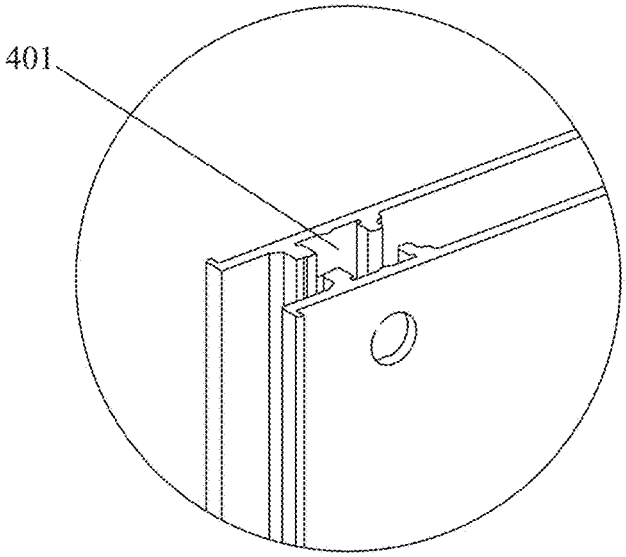
FIG. 10 is an enlarged view of the portion "10" in FIG. 9.

As shown in FIGS. 6 and 10, a guide protrusion 330 extends from the first connective element 311, and a guide groove 401 is provided in the guideway 400. The guide protrusion 330 moves in the guideway 400 such that the lift rack 300 can lift and fold up, or, descend and extend, along the guide groove 401.

When people need to open the door 200, the lift racks 300 lift and fold up, causing the louvers to fold up, the door is thus open.

When people need to close the door, the lift racks descend and extend, causing the louvers to extend, the door is thus closed.

Therefore, for the cupboard with the up-down louvered door of the present invention, the door can open adequately so as to facilitate taking out/putting in articles since the lift rack lifts and folds up, causing the louvers to fold up. In addition, no more space is occupied while opening the door, and it is safe while closing the door.

Embodiment 2

Figure 4:
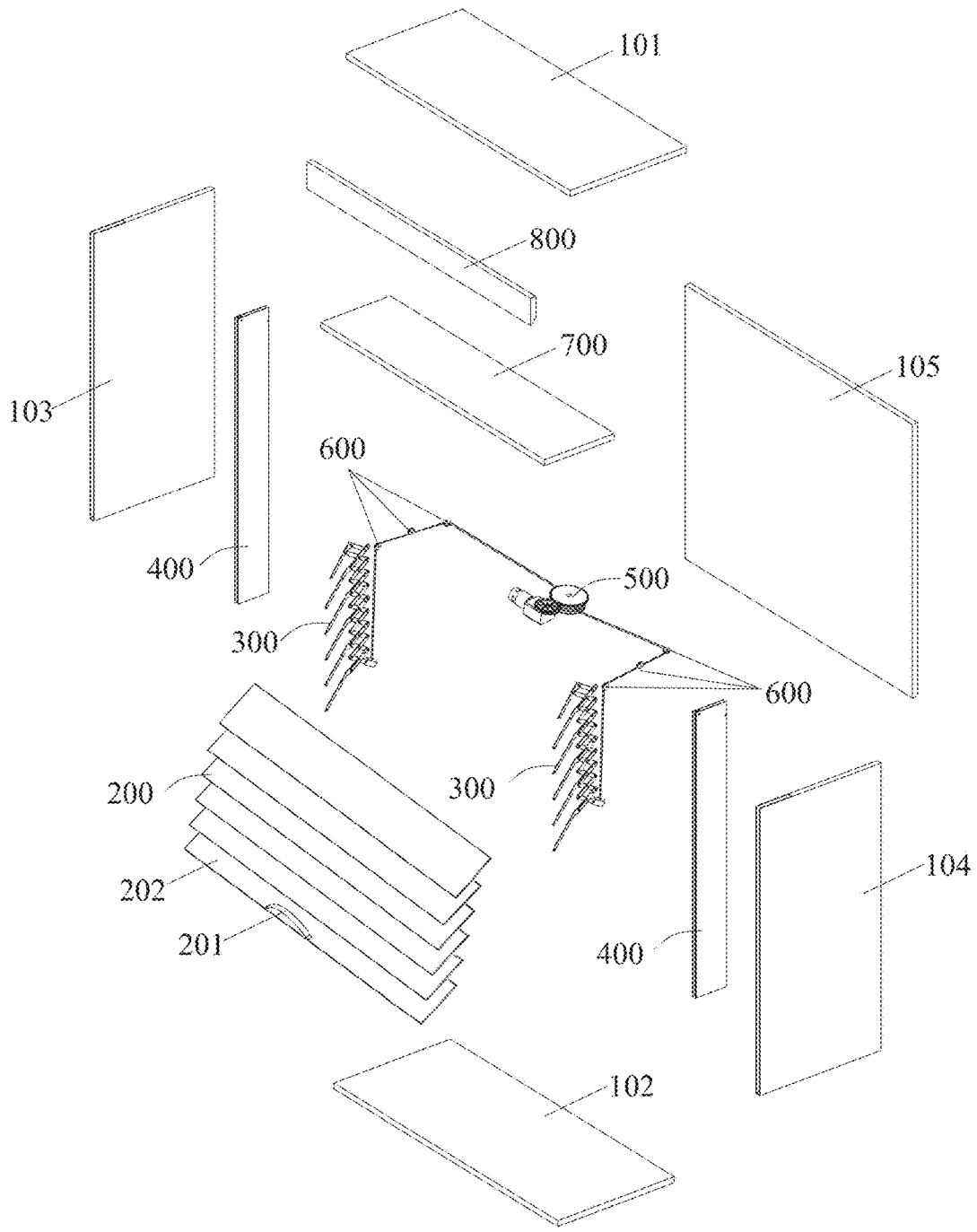
FIG. 4 is an exploded view of an embodiment of the cupboard, with the door partially opened.
Figure 5:
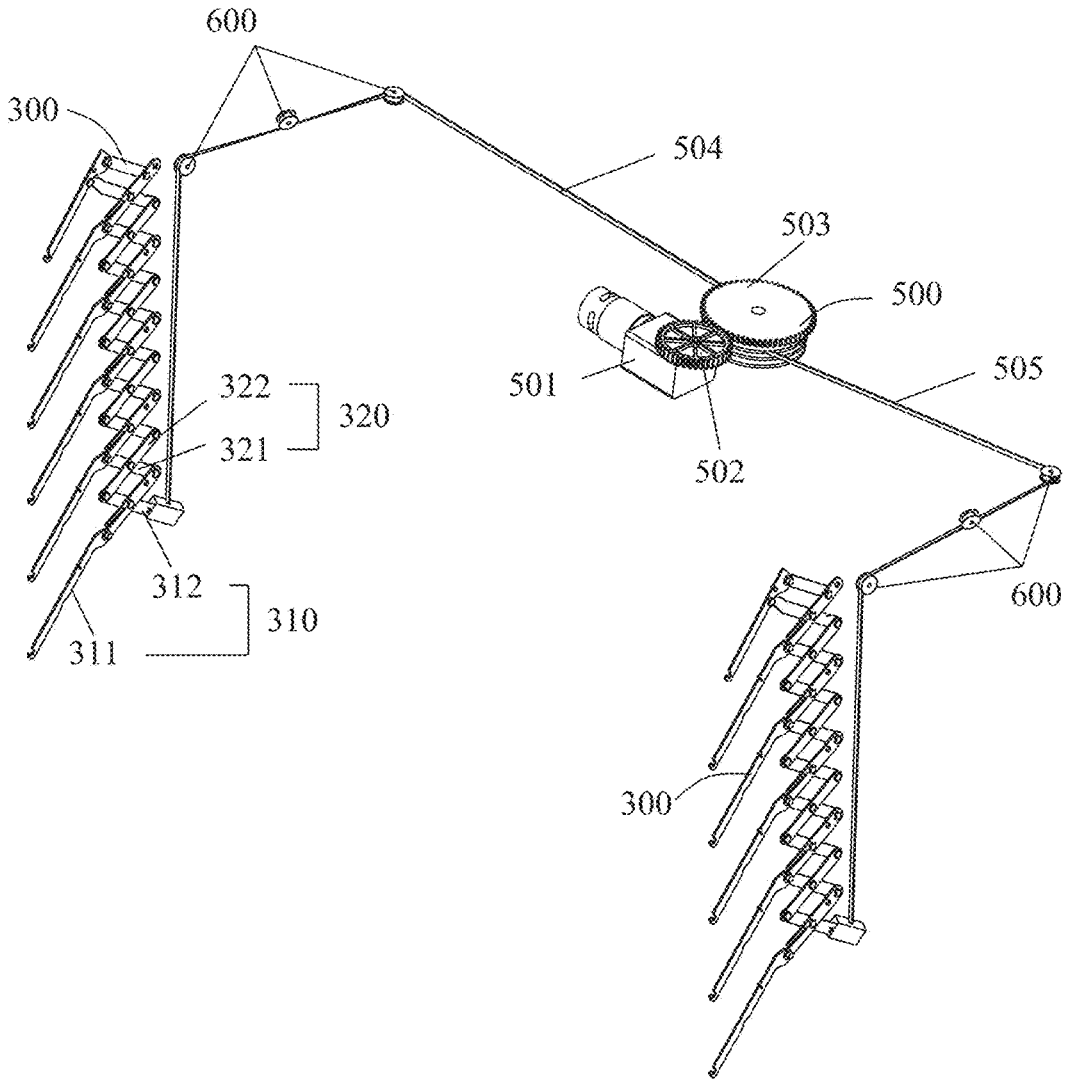
FIG. 5 is a structural schematic view showing the connection between lift racks and a motor transmission apparatus in the door shown in FIG. 4.

In an alternative embodiment of the invention shown in FIGS. 4-5, the cupboard also includes a motor transmission apparatus 500, a first belt 504, and a second belt 505.

The motor transmission apparatus 500 is mounted in a mounting plate 700 located beneath the top board 101. A baffle plate 800 is also mounted in the body 100.

One end of both belts 504 and 505 is secured to the motor transmission apparatus 500, and the other end of both belts 504 and 505 is connected to the lift racks 300.

The motor transmission apparatus 500 comprises a motor 501, a first gear 502 engaged with the motor 501, and a central gear 503 engaged with the first gear 502. The central gear 503 has two separate grooves for receiving the belts 504 and 505, which are also wound inversely or in opposite directions on the gear 503. Preferably, in this embodiment, the first gear 502 and the motor 501 are coaxial, and a transmission is arranged between the first gear 502 and a shaft of the motor 501.

Actuation of the motor transmission apparatus 500 and drives the first gear 502 to rotate, which in turn rotates the central gear 503, thereby winding both belts 504 and 505 oppositely or inversely around the two separate grooves on the central gear 503, whereby the lift racks 300 lift and fold up, causing the louvers to fold up, and thus the door is opened.

When people need to close the door, the motor 501 can be reversed, so that the door can be closed without human force.

The cupboard features good stability and long lifetime. Preferably the central gear is configured at a central position, and both belts 504 and 505 have an identical length, such that the belts bear a same pulling force.

Further the cupboard comprises a plurality of regulating wheels 600 for tightening/releasing the belts 504 and 505. The regulating wheels 600 are mounted on the left and right boards, for regulating the horizontalness of the louvers 202, making the belts bear the same pulling force during the door opening/closing.

The cupboard features simple structure, low cost, good stability and long lifetime.

It is understood that the belts may also be any other type of tension member, such as a cord, chain, rope, cable, or the like.

The embodiment described hereinbefore is merely preferred embodiment of the present invention and not for purposes of any restrictions or limitations on the invention. It will be apparent that any non-substantive, obvious alterations or improvement by the technician of this technical field according to the present invention may be incorporated into ambit of claims of the present invention.

What is claimed is:

1. A cupboard with an up-down louvered door, comprising:

a cupboard body, a door configured in the body, the door having a plurality of louvers, and a pair of lift racks in which the louvers are configured;

a motor transmission apparatus, and two belts; one end of both belts being secured to the motor transmission apparatus, and the other end of both belts being connected to the lift racks;

wherein when opening the door, the motor transmission apparatus rotates, and the lift racks lift and fold up, causing the louvers to fold up, and the door is opened;

wherein when closing the door, the motor transmission apparatus reverses, the lift racks descend and extend, causing the louvers to extend, and the door is closed;

each lift rack comprising a plurality of first lift units, and a plurality of second lift units in which each second lift unit being connected to two adjacent first lift units;

the louvers being connected to the first lift units, and each louver being secured to each corresponding first lift unit;

each first lift unit comprising a first connective element securing to the louver, and a second connective element hinged to a first connective element; and each second lift unit comprising a third connective element hinged to a first connective element, and a fourth connective element hinged to the second connective element; both the third connective element and the fourth connective element being hinged together.

2. The cupboard of claim 1, wherein a guide protrusion is set up on first connective element;

a guideway is configured in the body, for installing each of the lift racks; and a guide groove is configured in the guideway, for restricting the guide protrusion to move therein.

3. The cupboard of claim 2, wherein a mounting slot is configured at a left board of the body, and another mounting slot is configured at a right board of the body.

4. The cupboard of claim 1 wherein the motor transmission apparatus comprises a reversible electric motor, a first gear engaged with the motor, and a central gear engaged with the first gear; the central gear having two separate grooves for receiving the two belts, and the both belts are secured to and wound around the two separate grooves inversely.

5. The cupboard of claim 4, wherein the cupboard comprises a regulating wheels for adjusting the belts, and the regulating wheels are mounted adjacent opposite sides of the body.

6. A cupboard, comprising;

a box with opposite side walls, a top, a bottom, a rear wall, and an open front;

a door mounted on the box for movement between raised and lowered positions relative to the open front;

the door having a plurality of louvers with opposite ends, and a pair of brackets at each end of the louvers to support the louvers;

a pulley system mounted to the box and connected to the brackets; and a reversible motor mounted to the box and connected to the pulley system to raise and lower the brackets and louvers;

the pulley system having a pair of belts attached to the brackets to raise and lower the brackets and louvers when the motor is actuated in opposite directions; and the pulley system including a central pulley, and the belts being wrapped in opposite directions around the pulley.

7. The cupboard of claim 6 wherein the brackets each have a plurality of fingers, with each finger attached to one end of one of the louvers.

8. The cupboard of claim 7 wherein the brackets each have a scissor jack, with the fingers connected to the scissor jack.

9. The cupboard of claim 6 wherein the motor has a drive gear and the pulley system has a driven gear in mesh with the drive gear.

10. The cupboard of claim 6 further comprising a track system to guide movement of the door between raised and lowered positions.

11. The cupboard of claim 10 wherein the track system includes a guide in each sidewall of the box, a track on each bracket member, mating with one of the guide tracks to guide movement of the brackets during opening and closing of the door.

12. The cupboard of claim 11 wherein each track is a channel in the sidewall, and the track member is at least one protrusion on the bracket received in the channel.

13. The cupboard of claim 6 wherein the pulley system includes belts and wheels to adjust tension in the belts.

14. The cupboard of claim 6 wherein the motor is laterally centered in the box.

15. The cupboard of claim 6 wherein the motor is mounted inside the box.

16. The cupboard of claim 6 wherein the louvers are pivotal between a lowered closed position and a raised open position.

17. A cupboard with an up-down louvered door, comprising:

a cupboard body, a door configured in the body, the door having a plurality of louvers, and a pair of lift racks in which the louvers are configured;

a motor transmission apparatus, and two belts; one end of both belts being secured to the motor transmission apparatus, and the other end of both belts being connected to the lift racks;

wherein when opening the door, the motor transmission apparatus rotates, and the lift racks lift and fold up, causing the louvers to fold up, and the door is opened;

wherein when closing the door, the motor transmission apparatus reverses, the lift racks descend and extend, causing the louvers to extend, and the door is closed;

the motor transmission apparatus comprising a reversible electric motor, a first gear engaged with the motor, and a central gear engaged with the first gear; the central gear having two separate grooves for receiving the two belts, and the both belts being secured to and wound around the two separate grooves inversely.

18. The cupboard of claim 17, wherein the cupboard comprise a plurality of regulating wheels for adjusting the belts, and the regulating wheels are mounted adjacent opposite sides of the body.

19. The cupboard of claim 17, wherein each lift rack comprising a plurality of first lift units, and a plurality of second lift units in which each second lift unit being connected to two adjacent first lift units;

the louvers being connected to the first lift units, and each louver being secured to each corresponding first lift unit.

20. The cupboard of claim 19, wherein each first lift unit comprising a first connective element securing to the louver, and a second connective element hinged to a first connective element; and each second lift unit comprising a third connective element hinged to a first connective element, and a fourth connective element hinged to the second connective element; both the third connective element and the fourth connective element being hinged together.

21. The cupboard of claim 20, wherein a guide protrusion is set up on each first connective element;

a guideway is configured in the body, for installing each of the lift racks; and a guide groove is configured in the guideway, for restricting the guide protrusion to move therein.

22. The cupboard of claim 21, wherein a mounting slot is configured at a left board of the body, and another mounting slot is configured at a right board of the body.

* * * * *